US005282725A

United States Patent [19]

Shimizu

[11] Patent Number: 5,282,725

[45] Date of Patent: Feb. 1, 1994

[54] SLANT PLATE TYPE COMPRESSOR WITH VARIABLE DISPLACEMENT MECHANISM

[75] Inventor: Hidehiko Shimizu, Sawa, Japan

[73] Assignee: Sanden Corporation, Gunma, Japan

[21] Appl. No.: 986,567

[22] Filed: Dec. 7, 1992

[30] Foreign Application Priority Data

Dec. 5, 1991 [JP] Japan ..... 3-100385[U]

[51] Int. Cl.[5] ..... F04B 1/12

[52] U.S. Cl. ..... 417/222.1; 417/269

[58] Field of Search ..... 417/222.1, 222.2, 269, 417/270; 384/275, 420, 424, 912

[56] References Cited

U.S. PATENT DOCUMENTS

| | | | |
|---|---|---|---|
| 1,424,628 | 8/1922 | Drummond | 384/275 |
| 4,293,170 | 10/1981 | Brezosky | 384/275 |
| 4,685,866 | 8/1987 | Takenaka | 417/222.2 |
| 4,836,090 | 6/1989 | Smith | 417/222.2 |
| 4,884,952 | 12/1989 | Kanamaru | 417/222.2 |

*Primary Examiner*—Richard A. Bertsch
*Assistant Examiner*—Peter Korytnyk
*Attorney, Agent, or Firm*—Baker & Botts

[57] ABSTRACT

A slant plate type compressor with a variable displacement mechanism is disclosed. The compressor includes a compressor housing having a cylinder block provided with a plurality of cylinders and a crank member. A piston is slidably fitted within each of the cylinders and is reciprocated by a drive mechanism. The drive mechanism includes a drive shaft rotatably supported by the compressor housing, a cam rotor fixed on the drive shaft and a slant plate having a surface with an adjustable incline angle. The incline angle is varied in accordance with the pressure in the crank chamber. A wobble plate is disposed adjacent the slant plate to convert the rotating motion of the drive shaft, the rotor and the slant plate into the reciprocating motion of the pistons which are coupled to the wobble plate through corresponding connecting rods. A hinged joint mechanism hingedly connects an arm portion of the slant plate to an arm portion of the rotor to permit variations in the incline angle of the slant plate. An abrasion preventing mechanism formed of steel is disposed between the arm portion of the cam rotor and the arm portion of the slant plate to effectively reduce abnormal abrasion on the frictional surface of the arm portion of the rotor.

4 Claims, 2 Drawing Sheets

SLANT PLATE TYPE COMPRESSOR WITH VARIABLE DISPLACEMENT MECHANISM

BACKGROUND OF THE INVENTION

1. Field of the Invention

The present invention generally relates to a refrigerant compressor and, more particularly, to a slant plate type compressor, such as a wobble plate type compressor with a variable displacement mechanism suitable for use in an automotive air conditioning system.

2. Description of the Prior Art

A slant plate type refrigerant compressor with a variable displacement mechanism suitable for use in an automotive air conditioning system is disclosed in Japanese Patent Application Publication No. 1-142277. As disclosed therein, the compression ratio of the compressor may be controlled by changing the slant angle of the sloping surface of the wobble plate. The slant angle of the wobble plate is adjusted so as to maintain a constant suction pressure in response to changes in the pressure differential between the suction chamber and the crank chamber.

Referring to FIG. 1, compressor 10 includes cylindrical housing assembly 20 including cylinder block 21, front end plate 23 disposed at one end of cylinder block 21, crank chamber 22 formed between cylinder block 21 and front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is centrally formed in front end plate 23 for rotatably supporting drive shaft 26 through bearing 30 disposed therein. The inner end portion of drive shaft 26 is rotatably supported by bearing 31 disposed within central bore 210 of cylinder block 21. Bore 210 extends to a rearward (to the right in FIG. 1) end surface of cylinder block 21 and houses valve control mechanism 19.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Slant plate 50 is disposed adjacent cam rotor 40 and includes opening 53 through which drive shaft 26 passes.

Referring to FIGS. 2 and 3, a hinged joint mechanism coupling cam rotor 40 and slant plate 50 is shown. Slant plate 50 includes arm 51 having first and second axial end surfaces **51*a* and 51*b*. Cam rotor 40 includes arm 41 which includes first and second cylindrical projections 411 and 412 axially projecting from the opposite end surfaces of a terminal end portion of arm 41. Hole 413 is axially bored through the terminal end portion of arm 41. Pin member 42 includes shaft portion 42*a* and head portion 42*b* having a diameter greater than the diameter of shaft portion 42*a*. Shaft portion 42*a* of pin member 42 loosely penetrates through slot 52 of arm 51. Hole 413 of arm 41 of cam rotor 40 fixedly receives shaft portion 42*a* of pin member 42 by forcible insertion. Snap ring 43 is fixedly secured to one end region of shaft portion 42*a* opposite to head portion 42*b*. Arm 41 of cam rotor 40, pin member 42 and slot 52 of arm 51 of slant plate 50 form a hinged joint mechanism. Pin member 42 slides within the slot 52 to allow adjustment of the angular position of slant plate 50 with respect to the longitudinal axis of drive shaft 26. Axial movement of arm 51 of slant plate 50 is limited by head portion 42*b* of pin member 42 and cylindrical projection 412 of arm 41 of rotor 40. Arm 41 of rotor 40 is made of cast iron. Pin member 42 and arm 51 of slant plate 50** are made of steel.

Wobble plate 60 is rotatably mounted on slant plate 50 through bearings 61 and 62. Fork shaped slider 63 is attached to the outer peripheral end of wobble plate 60 by pin member 64 and is slidably mounted on sliding rail 65 disposed between front end plate 23 and cylinder block 21. Fork shaped slider 63 prevents rotation of wobble plate 60. Wobble plate 60 nutates along rail 65 when cam rotor 40 rotates. Cylinder block 21 includes a plurality of peripherally located cylinder chambers 70 in which pistons 71 reciprocate. Each piston 71 is coupled to wobble plate 60 by a corresponding connection rod 72.

A pair of seamless piston rings 73 made of polytetrafluoroethylene is disposed at an outer peripheral surface of piston 71. Piston rings 73 prevent the wear of both aluminum alloy piston 71 and aluminum alloy cylinder block 21 due to friction therebetween and prevent any direct contact between pistons 71 and the inner surface of cylinder 70.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion **241*a* which is connected to an evaporator (not shown) of an external cooling circuit (not shown). Discharge chamber 251 is provided with outlet portion 251*a* connected to a condenser (not shown) of the cooling circuit (not shown). Gaskets 27 and 28 are positioned between cylinder block 21 and the inner surface of valve plate 25 and the outer surface of valve plate 25 and rear end plate 24, respectively. Gaskets 27 and 28 seal the mating surfaces of cylinder block 21, valve plate 25 and rear end plate 24. Gaskets 27 and 28 and valve plate 25 form a valve plate assembly 200**.

A first communication path linking crank chamber 22 and suction chamber 241 is formed in cylinder block 21. This first communication path includes valve control mechanism 19 which includes cup-shaped casing 191 which defines valve chamber 192 therein. O-ring **19*a* is disposed between an outer surface of casing 191 and an inner surface of bore 210 to seal the mating surface of casing 191 and cylinder block 21. A plurality of holes 19*b* are formed at the closed end (to the left in FIG. 1) of cup-shaped casing 191 to permit crank chamber pressure into valve chamber 192 through gap 31*a* existing between bearing 31 and cylinder block 21. Circular plate 194 having hole 194*a* formed at the center thereof is fixed to the open end of cup-shaped casing 191. Bellows 193, which is disposed within valve chamber 192, contracts and expands longitudinally in response to the crank chamber pressure. The forward (to the left in FIG. 1) end of bellows 193 is fixed to the closed end of casing member 191. VaLve member 193*a* is attached at rearward (to the right in FIG. 1) end of bellows 193 to selectively control the opening and closing of hole 194***a*. Valve chamber 192 and suction chamber 241 are linked by hole 194*a*, central portion 211 of bore 210, conduit 195 formed in cylinder block 21 and hole 196 formed in valve plate assembly 200. Valve retainer 15 is secured to the rear end surface of valve plate assembly 200 by bolts 151.

Communication path 18, which is bored longitudinally from a forward end surface of cylinder block 21 to a rear end surface of valve retainer 15, is a second communication path formed in the cylinder block to link discharge chamber 251 to crank chamber 22. Communication path 18 controls the flow of refrigerant gas from discharge chamber 251 to crank chamber 22. Large diameter conduit portion 181 of communication path 18 has filter screen 182 disposed therein. Capillary tube 183, which performs a throttling function to reduce the pressure of refrigerant gas from discharge chamber 251 to crank chamber 22, is fixed within communication path 18 and is coupled to filter screen 182.

During operation of compressor 10, drive shaft 26 is rotated by the engine of the vehicle (not shown) through electromagnetic clutch 300. Cam rotor 40 is rotated with drive shaft 26 causing slant plate 50 to rotate. The rotation of slant plate 50 causes wobble plate 60 to nutate. The nutating motion of wobble plate 60 reciprocates pistons 71 in their respective cylinders 70. As pistons 71 are reciprocated, refrigerant gas which is introduced into suction chamber 241 through inlet portion 241*a* is drawn into cylinders 70 through suction ports 242 and subsequently compressed. The compressed refrigerant gas is discharged from cylinders 70 to discharge chamber 251 through respective discharge ports 252 and then into the cooling circuit through outlet portion 251*a*. A portion of the discharged refrigerant gas in discharge chamber 251 continuously flows into crank chamber 22 through conduit 18 at a reduced pressure as a function of capillary tube 183.

Valve control mechanism 19 is responsive to the pressure in crank chamber 22. When the pressure in crank chamber 22 exceeds a predetermined value, hole 194*a* is opened by the contraction of bellows 193. The opening of hole 194*a* permits fluid communication between crank chamber 22 and suction chamber 241. As a result, the slant angle of slant plate 50 increases to maximize the displacement of the compressor. However, when the pressure in crank chamber 22 is less than a predetermined value, hole 194*a* is closed by valve member 193*a* of bellows 193. This action blocks communication between crank chamber 22 and suction chamber 241. As a result, the slant angle of slant plate 50 is controlled by changes in the pressure in crank chamber 22 to vary the displacement of the compressor.

With respect to the hinged joint mechanism, an outer peripheral surface of shaft portion 42*a* of pin member 42 and an inner wall of slot 52 of arm 51 frictionally slide against each other. Furthermore, first axial end surface 51*a* of arm 51 and the axial end surface of second cylindrical projection 412 of arm 41 frictionally slide against each other, and second axial end surface 51*b* of arm 51 and an inner end surface of head portion 42*b* of pin member 42 also frictionally slide against each other.

Since pin member 42 and arm 51 of slant plate 50 are made of steel, the frictional engagement between the outer peripheral surface of shaft portion 42*a* of pin member 42 and the inner wall of slot 52 of arm 51 occurs between two hard metals. Similarly, the frictional engagement between the second axial end surface 51*b* of arm 51 and the inner end surface of head portion 42*b* of pin member 42 occurs between two hard metals. Therefore, the frictional engagement between pin member 42 and arm 51 of slant plate 50 occurs without causing abnormal abrasion on the frictional contact surfaces of each of pin member 42 and arm 51.

On the other hand, the frictional engagement between first axial end surface 51*a* of arm 51 and the axial end surface of second cylindrical projection 412 of arm 41 occurs between hard and soft metals. During operation of the compressor, the axial end surface of second cylindrical projection 412 is not uniformly worn away because that area A (as shown in FIG. 4) of the axial end surface of second cylindrical projection 412 more frequently frictionally slides on the axial end surface of second cylindrical projection 412. Therefore, durability of the hinged joint mechanism between rotor 40 and slant plate 50 abnormally decreases.

SUMMARY OF THE INVENTION

Accordingly, it is an object of this invention to provide a variable capacity type slant plate compressor having a durable hinged joint between a slant plate and a cam rotor. The variable capacity type slant plate compressor according to the present invention includes a compressor housing enclosing a crank chamber, a suction chamber and a discharge chamber therein. The compressor housing comprises a cylinder block having a plurality of cylinders formed therethrough. A piston slidably fits within each of the cylinders. A driving mechanism is coupled to the pistons for reciprocating the pistons within the cylinders. The driving mechanism includes a drive shaft rotatably supported in the housing, a cam rotor fixedly connected to the dive shaft, and a coupling mechanism for drivingly coupling the cam rotor to the pistons such that rotary motion of the cam rotor is converted into reciprocating motion of the pistons.

The coupling mechanism includes a slant plate having a surface disposed at an adjustable inclined angle relative to a plane perpendicular to the drive shaft. The incline angle of the slant plate is adjustable to vary the capacity of the compressor. A passageway formed in the housing links the crank chamber and the suction chamber in fluid communication. A capacity control mechanism associated with the passageway varies the capacity of the compressor by adjusting the inclined angle of the slant plate.

The above mentioned cam rotor is coupled to the slant plate by means of a hinged joint mechanism which allows the inclination of the slant plate to vary. hinged joint mechanism includes an abraison reduction mechanism for reducing hinged joint mechanism includes an abrasion reduction mechanism for reducing abrasion on the frictional contact surfaces of the cam rotor and the slant plate.

DETAILED DESCRIPTION OF THE PREFERRED EMBODIMENTS

Figure 1:
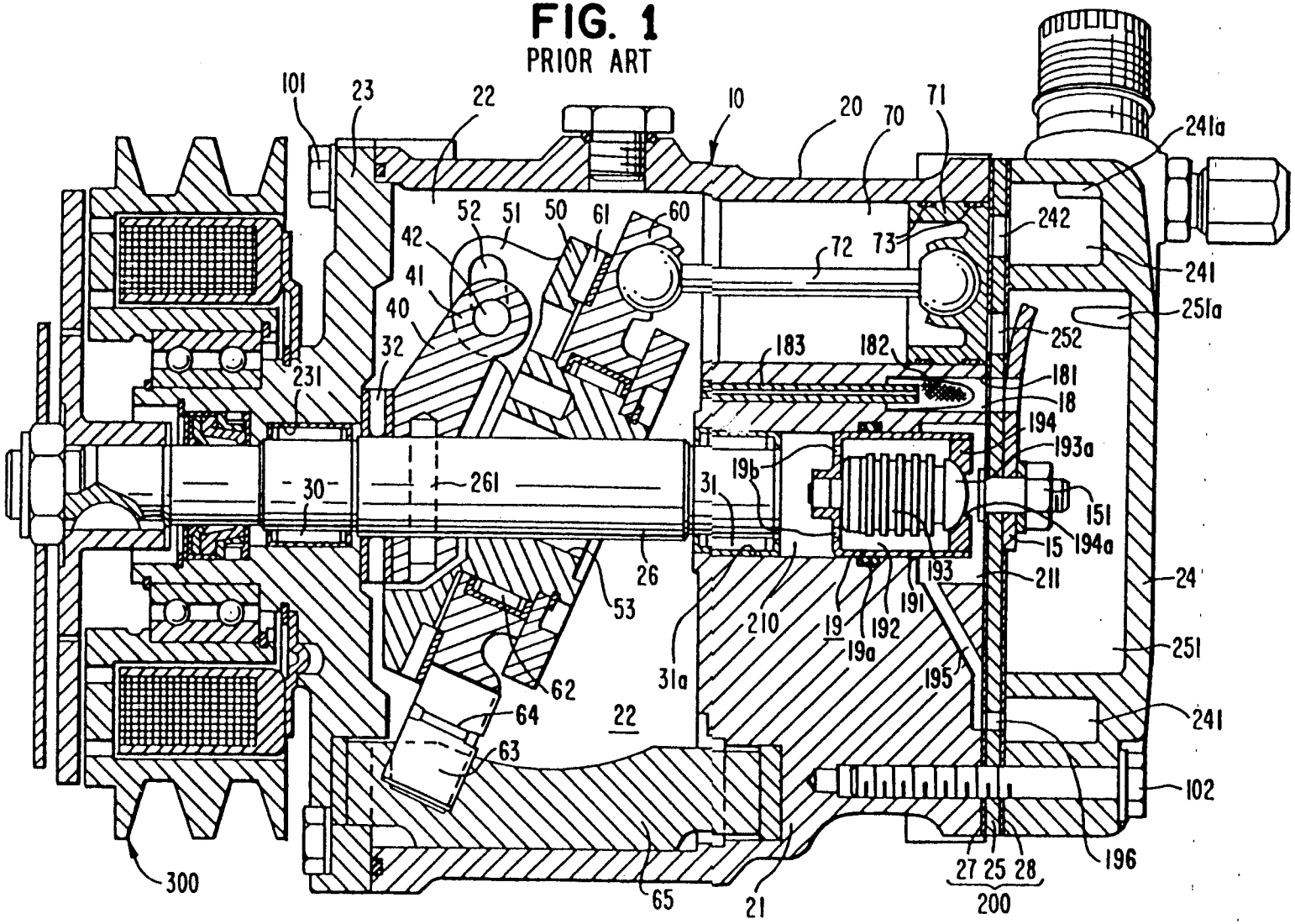
FIG. 1 PRIOR ART
FIG. 1 is a longitudinal sectional view of a wobble plate type refrigerant compressor with a variable displacement mechanism in accordance with one prior art embodiment.
Figure 2:
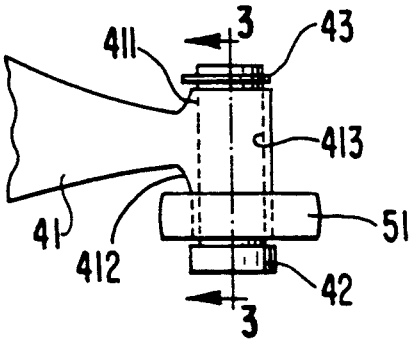
FIG. 2 PRIOR ART
FIG. 2 is a side view of a hinged joint mechanism between a cam rotor and a slant plate of the compressor shown in FIG. 1.
Figure 3:
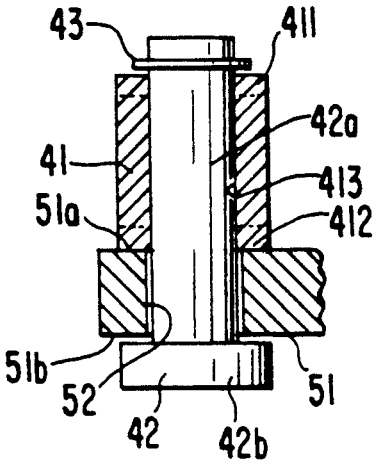
FIG. 3 PRIOR ART
FIG. 3 is an enlarged cross sectional view taken along line 3—3 of FIG. 2.
Figure 4:
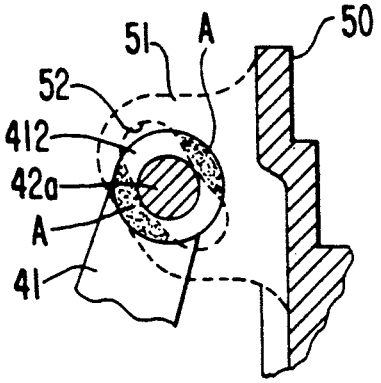
FIG. 4 PRIOR ART
FIG. 4 is a diagrammatic partial view of a hinged joint mechanism for the compressor shown in FIG. 1.
Figure 5:
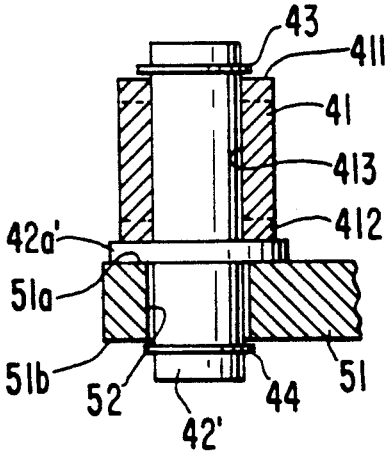
FIG. 5 is a view similar to FIG. 3 illustrating an essential portion of a hinged joint mechanism for a wobble plate type refrigerant compressor with a variable displacement mechanism in accordance with a first embodiment of the present invention.

FIG. 5 illustrates an essential portion of a hinged joint mechanism for a wobble plate type refrigerant compressor with a variable displacement mechanism in accordance with a first embodiment of the present invention. In the drawing, the same numerals are used to denote the corresponding elements shown in FIGS. 1–4 so that an explanation thereof is omitted.

Referring to FIG. 5, pin member 42' loosely penetrates through slot 52. Hole 413 of arm 41 of cam rotor 41 fixedly receives pin member 42' by forcible insertion. Annular flange 42'*a* radially extends from and is integral with the outer peripheral surface of pin member 42' at a position which is located between arm 41 of cam rotor 40 and arm 51 of slant plate 50. Annular flange 42'*a* moves together with arm 41 of cam rotor 40. Snap ring 44 is fixedly secured to the other end region of pin member 42' opposite to snap ring 43. Axial movement of arm 51 of slant plate 50 is limited by snap ring 44 and annular flange 42'*a* of pin member 42'.

In the first embodiment of the present invention, during operation of the compressor, the axial end surface of second cylindrical projection 412 of arm 41 of cam rotor 40 slides on the first axial end surface 51*a* of arm 51 of slant plate 50 through annular flange 42'*a* which moves together with arm 41 of rotor 40. Therefore, no frictional hard-soft metal contact is carried out in the hinged joint mechanism during operation of the compressor. Accordingly, an abnormal decrease in the durability of the hinged joint mechanism between rotor 40 and slant plate 50 can be effectively reduced.

Figure 6:
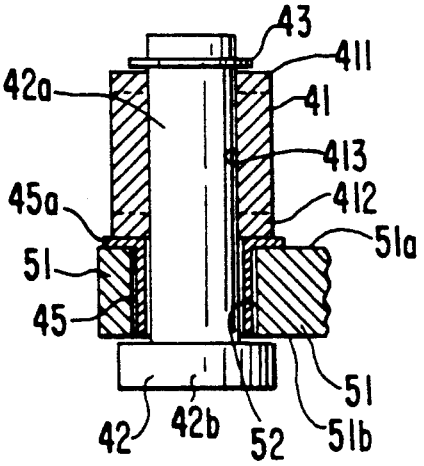
FIG. 6 is a view similar to FIG. 3 illustrating an essential portion of a hinged joint mechanism for a wobble plate type refrigerant compressor with a variable displacement mechanism in accordance with a second embodiment of the present invention.

FIG. 6 illustrates an essential portion of a hinged joint mechanism for a wobble plate type refrigerant compressor with a variable displacement mechanism in accordance with a second embodiment of the present invention. In the drawing, the same numerals are used to denote the corresponding elements shown in FIGS. 1–4 so that an explanation thereof is omitted.

Referring to FIG. 6, collar 45 having a radial annular flange 45*a* is loosely mounted about shaft portion 42*a* of pin member 42. Collar 45 loosely penetrates through slot 52 of arm 51 of slant plate 50. Annular flange 45*a* is loosely disposed between the axial end surface of second cylindrical projection 412 of arm 41 of cam rotor 40 and the first axial end surface 51*a* of arm 51 of slant plate 50. Therefore, collar 45 can rotate around pin member 42. An outer periphery of annular flange 45*a* radially extends beyond the outer periphery of second cylindrical projection 412 of arm 41 of rotor 40. Axial movement of arm 51 of slant plate 50 is limited by head portion 42*b* of pin member 42 and arm 41 of rotor 40.

Figure 7:
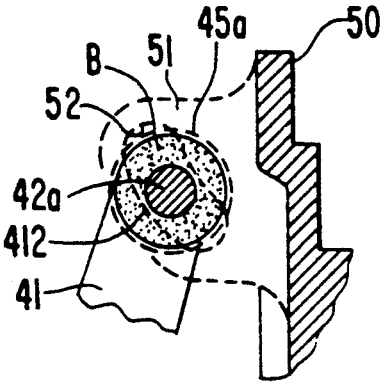
FIG. 7 is a view similar to FIG. 4 illustrating the effect of operation of the hinged joint mechanism shown in FIG. 6.

In the second embodiment, during operation of the compressor, one end surface of annular flange 45*a* of collar 45 uniformly frictionally engages the axial end surface of second cylindrical projection 412 because collar 45 can rotate around pin member 42. Therefore, the full axial end surface of second cylindrical projection 412 of arm 41 of cam rotor 40 is uniformly and slightly worn away as shown by area B in FIG. 7. Accordingly, an abnormal decrease in the durability of the hinged joint mechanism between rotor 40 and slant plate 50 can be effectively reduced.

This invention has been described in detail with respect to the preferred embodiment. These embodiments, however, merely are for example only and this invention is not restricted thereto. It will be easily understood by those skilled in the art that variations and modifications can be easily made within the scope of the invention, as defined by the appended claims.

I claim:

1. In a slant plate type compressor including a compressor housing enclosing a crank chamber, a suction chamber and a discharge chamber therein, said compressor housing comprising a cylinder block having a plurality of cylinders formed therethrough, a piston slidably fitted within each of said cylinders, a driving means coupled to said pistons for reciprocating said pistons within said cylinders, said driving means including a drive shaft rotatably supported in said housing, a cam rotor fixedly connected to said drive shaft, and coupling means for drivingly coupling said cam rotor to said pistons such that rotary motion of said cam rotor is converted into reciprocating motion of said pistons, said coupling means including a slant plate having a surface disposed at an adjustable inclined angle relative to a plane perpendicular to said drive shaft, the inclined angle of said slant plate adjustable to vary the capacity of the compressor, a passageway formed in said housing and linking said crank chamber and said suction chamber in fluid communication, and capacity control means coupled to said passageway for varying the capacity of the compressor by adjusting the inclined angle of said slant plate, said cam rotor coupled to said slant plate by means of a hinged joint mechanism which permits the inclination of said slant plate to vary, the improvement comprising:

said hinged joint mechanism including abrasion reduction means for reducing abrasion between all frictional contact surfaces of said cam rotor and said slant plate, said abrasion reducing means including radially extending hard metal inserts between the frictional contact surfaces of said cam rotor and said slant plate at least one of which is made of soft metal.

2. The slant plate type compressor of claim 1 wherein said hinged joint mechanism includes a first arm portion extending from said cam rotor and a second arm portion extending from said slant plate, said second arm portion including a slot through which a pin member passes, said pin member slidable along said slot and fixedly connected to said first arm portion.

3. The slant plate type compressor of claim 2 wherein said abrasion reduction means includes an annular flange radially extending from and integral with an outer peripheral surface of said pin member at a position which is located between said first and second arm portions.

4. The slant plate type compressor of claim 2 wherein said abrasion reduction means includes an annular cylindrical member which is loosely mounted about said pin member and loosely received in said slot, said annular cylindrical member including an annular flange radially extending from one axial end thereof and loosely disposed between said first and second arm portions.

* * * * *